United States Patent [19]

Arene

[11] Patent Number: 4,907,512

[45] Date of Patent: Mar. 13, 1990

[54] TANDEM PROJECTILES CONNECTED BY A WIRE

[75] Inventor: Francois Arene, Paris, France

[73] Assignee: Societe d'Etudes, de Realisations et d'Applications Techniques, Paris, France

[21] Appl. No.: 141,270

[22] Filed: Jan. 6, 1988

[30] Foreign Application Priority Data

Jan. 14, 1987 [FR] France ..... 87 00319

[51] Int. Cl.[4] ..... F42B 13/50; F42B 13/56

[52] U.S. Cl. ..... 102/476; 102/489; 102/504

[58] Field of Search ..... 102/397, 476, 489, 473, 102/501, 504; 244/3, 12

[56] References Cited

U.S. PATENT DOCUMENTS

| | | | |
|---|---|---|---|
| 1,343,747 | 6/1920 | Radakovich | 102/504 |
| 2,804,823 | 9/1951 | Jablansky | 102/476 |
| 4,271,761 | 6/1981 | Canning et al. | 102/504 |
| 4,327,644 | 5/1982 | Stancil | 102/504 |
| 4,497,253 | 2/1985 | Sabranski | 102/476 |
| 4,524,697 | 6/1985 | Bocker et al. | 102/504 |
| 4,567,829 | 2/1986 | Ziemba et al. | 102/476 |

FOREIGN PATENT DOCUMENTS

| | | | |
|---|---|---|---|
| 75404 | 2/1919 | Fed. Rep. of Germany | 102/489 |
| 2310547 | 12/1976 | France . | |
| 2540238 | 8/1984 | France . | |
| 22556 | of 1915 | United Kingdom | 102/504 |
| 547848 | 9/1942 | United Kingdom | 102/504 |

*Primary Examiner*—Harold J. Tudor

*Attorney, Agent, or Firm*—Sandler & Greenblum

[57] ABSTRACT

A tandem projectile is made up of a front and rear projectile. The projectiles are connected by a wire which unwinds during flight of the projectiles. The front projectile leaves a launcher at greater initial velocity than the rear projectile, so that a wire in the front unwinds and the rear projectile follows the front projectile towards a target.

18 Claims, 2 Drawing Sheets

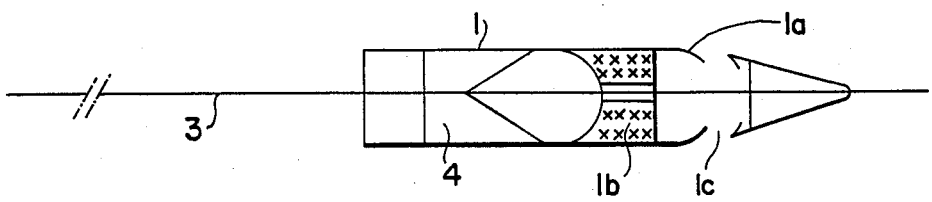
FIG. 1b
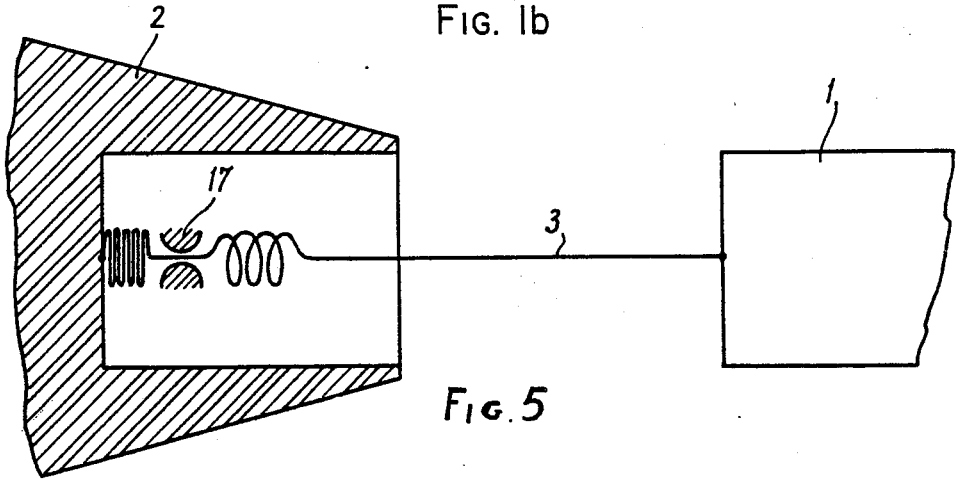
FIG. 5
FIG. 6
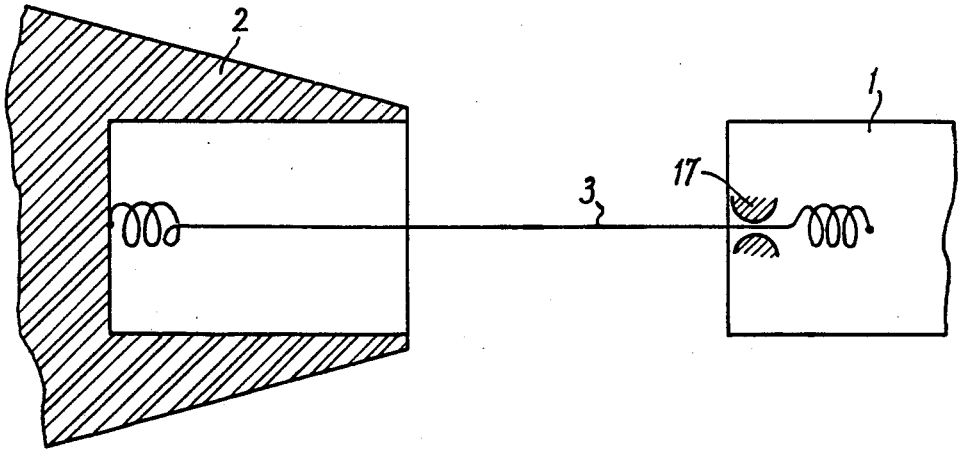

TANDEM PROJECTILES CONNECTED BY A WIRE

FIELD OF THE INVENTION

The present invention relates to improvements in and relating to tandem charges.

It is known that the protection of armored vehicles has greatly progressed during these last years, particularly with the appearance of active multilayer armorings upstream of the main armoring.

Such armorings are capable of degrading in considerable proportions the perforation effect of antitank ammunition, notably that of hollow charges as well as their effect downstream of the main armoring. The disorganization of the hollow charge jet can thus be obtained with the "light active multilayer armorings", characterized by a very small surface mass.

It is also known that the tandem charge is the answer to such active multilayer armorings. The front charge initiates the active protection and the rear charge which forms generally the main charge of the tandem is fired after the end of the active protection "lifetime", that is, when the previously initiated elements of the latter are no more capable of disturbing the effects of the rear charge generally made of a hollow charge.

BACKGROUND OF THE INVENTION

The concept of such a tandem charge and a first embodiment are disclosed in commonly owned French Patent Application Ser. No. 7514 091 filed on May 6, 1975, and published as No. 2 310 547.

Nowadays, one notices a reinforcement of the active protections with, notably, the appearance of "heavy active protections" characterized by "lifetimes" which are substantially longer than those of the light active protections.

Various means have already been proposed, and even developped, in order to counter such a menace: the front charge and the rear charge incorporated in the same projectile are spaced apart and protective elements are interposed inbetween, a proximity fuse is used, etc.

OBJECTS AND SUMMARY OF THE INVENTION

All the means already known for improving the efficiency of the tandem charge versus "active and long lifetime" armorings are relatively complex and bulky. Therefore, they can be considered as ill adapted to non guided ammunition. This is the reason why the applicant, who has a lengthy experience with this type of ammunition, is applying his knowledge to the present invention and has set as objective the creation of a tandem charge of a new disposition capable of attacking the most modern armored vehicles, even if they are fitted out with "long lifetime" active protections, for example of several milliseconds, while limiting the mass and space requirement of said tandem charge to a moderate level, compatible with highly scattered non-guided ammunition.

To this end, the invention relates to a tandem charge, notably for fighting armored vehicles and more particularly those whose protection includes long lifetime active prearmorings, characterized in that it is made, on the flight path, of two projectiles each including an explosive effect charge, said two projectiles being connected by a connecting wire so that the rear projectile follows the front projectile.

Thus and according to the invention, said two projectiles follow their flight paths at a speed V and the rear charge can exert its full efficiency if it reaches the target with a delay with respect to the front projectile which is superior to the "lifetime" $\Delta T$ of the active prearmorings characterizing the menace. To reach this aim, it is sufficient that the length L of the connecting wire between the charges is superior to product $V. \Delta T$.

Still according to the invention, the head projectile is projected, at the outlet of the launcher, with an extra initial speed $\Delta Vo$ with respect to the initial speed Vo of the projectile including the rear charge.

The difference of speed between the two mobiles forming the front and rear projectiles provides for the unwinding of the connecting wire the tension of which is ensured, at the end of the unwinding, by a difference of ballistic coefficient, or even by a cruising launcher incorporated to the head projectile including the front charge.

The invention is particularly well adapted to ballistic systems in which the projectiles are not biased by deterministic charge factors. An example of the invention discloses hereinbelow the way the aerodynamic stability of the head projectile, connecting wire and rear projectile assembly is provided.

According to another feature of the invention, the initial projection of the head projectile with an initial extra speed $\Delta Vo$ is preferentially provided (this example not being limiting) by an expansion of the compressed air, in the ogive of the rear projectile, due to a relative recoil of the head projectile at the start of the shot, under the effect of inertia forces.

Still according to the invention and for limiting the tensioning effort at the end of the unwinding of the connecting wire, the apparent lengthening of said wire is preferentially increased (this being a non-limiting example) of the stroke of a damping device or of an activation device tied to one of the ends of said wire.

According to another feature of the present invention, the extra speed $\Delta Vo$ of the projectile is cancelled at the end of the unwinding of the connecting wire by a passage of said wire through a die which can be connected either to the rear projectile or to the head projectile.

This enumeration is not exhaustive and other advantages and characteristics of this invention will become more apparent from the hereunder description which refers to various embodiments of tandem charges according to the invention.

It should be well understood that these are only examples and that the invention can also be applied, without departing from its scope, to any other embodiments, shapes, proportions, construction arrangements, applications, etc.

BRIEF DESCRIPTION OF DRAWINGS

In this description, referece will be made to the accompanying drawings wherein:

FIG. 1(*b*) is a view showing a propulsion device integrated into the front projectile

FIG. 5 is a partial view showing the die placed in the rear projectile; and

FIG. 6 is a partial view, similar to FIG. 5, but in which the die is mounted in the head projectile.

DETAILED DESCRIPTION OF THE INVENTION

Figure 1A:
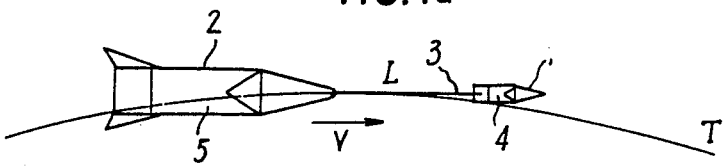
FIG. 1(*a*) is a general view, on the flight path, of the tandem charge with connecting wire, once said wire is unwound.
Figure 2:
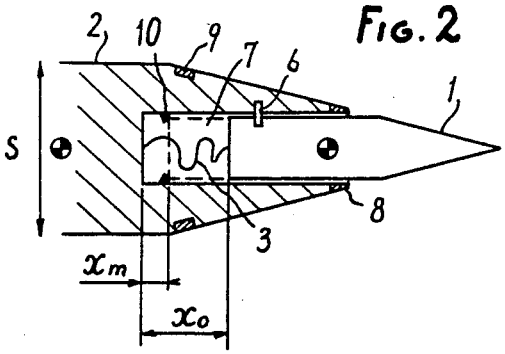
FIG. 2 is a partial view illustrating the initial position of the head projectile, prior to the shot being fired, in the ogive of the rear projectile, according to a first embodiment of the invention in which the rear projectile forms the main projectile.
Figure 3:
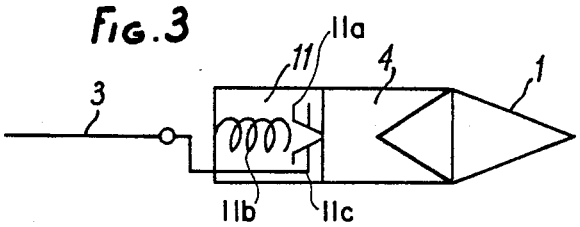
FIG. 3 is a view of the head projectile at the end of the unwinding.

According to a first embodiment of the invention, shown in FIGS. 1 to 3, the tandem charge is made of a head projectile 1 and of a rear projectile or main projectile 2, connected by a connecting wire 3 and including respectively the hollow charge 4 capable of initiating heavy active prearmorings and the main hollow charge 5 capable of perforating the main armoring of the target in consideration.

FIG. 1(*a*) shows that, according to this example of the invention, with the head projectile 1 and the rear main projectile 2 having preferentially their own aerodynamic stability, the tension of wire 3 enhances this stability so that, after a damping of disturbances, the mobiles 1 and 2 and wire 3 assembly is characterized by a position in alignment in a direction close to the aerodynamic speed, or of speed V related to the ground, and of the tangent to flight path T.

FIG. 1(*b*) shows a conventional propulsion device integrated into the front projectile. In the FIG., 1(*a*) is the propulsion device nozzle, 1(*c*) the nozzles and 1(*b*) a propellant. This is a conventional feature and it constitutes, but one example to implant a propulsion device in the projectile.

Still according to this embodiment and with reference to FIG. 2, one sees that head projectile 1 is fixed by one or several pegs such as 6 in a bore 7 of section "s" formed in the ogive of the main projectile 2 on which are placed the ogive and "shoulder" contactors 8 and 9, capable of initiating in known manner the pyrotechnic chain of the main projectile 2 when said projectile hits the target.

Moreover, FIG. 2 shows also that, according to this embodiment of the invention:

- the shell base of the head projectile, in its initial position and prior to the shearing of peg 6, is in correspondance with distance $x_o$ to the bottom of bore 7;
- during the displacement through the core and under the effect of the inertia forces due to the acceleration of projectiles 1 and 2 by the launcher, the shell base of head projectile 1 which is imparted with a recoil motion comes in contact with the abutment or abutments 10, at a distance $x_m$ from the bottom of bore 7.

In this example of the invention, the abutment or abutments 10 are placed preferentially (although not in a limiting way) such that the air pressure Pm at the rear of projectile 1 when in abutment, corresponds to the balance of the inertia efforts caused by the head projectile when passing through the launcher muzzle with acceleration$\Gamma G$.

It is demonstrated that if Po is used for calling the atmospheric pressure, M and m the respective masses of the main projectile 2 and of the head projectile 1 and when $\gamma \sim 1.4$, this being the air polytropic coefficient, one has:

$$Pm \sim \left(\frac{xo}{xm}\right)^{\gamma} Po \tag{A}$$

$$\Gamma_G \sim \Delta \frac{Pm - Po}{m} \sim \left[\left(\frac{xo}{xm}\right)^{\gamma} - 1\right]\frac{\Delta Po}{m} \tag{B}$$

When this example of the invention is embodied, it is also known how to define the values of $x_o$ and $x_m$ in order to provide the head projectile 1 with the required $\Delta$Vo, since one can demonstrate that:

$$\Delta Vo \sim \sqrt{2\Delta \frac{Po}{Pm}\left[\frac{}{\gamma - 1}\left(\frac{1}{x_m\gamma - 1} - \frac{1}{x_o\gamma - 1}\right) - (x_o - x_m)\right]} \tag{C}$$

This $\Delta$Vo is of course chosen in such manner that the unwinding ends at a distance $\Delta X_D$, $\Delta X_D$ is the distance at which the unwinding of the wire 3 stops, when the front projectile is at the end of the relative spacing movement with respect to the rear projectile as seen in FIG. 1(*a*). $\Delta X_M$ is the minimum range of tandem charge, i.e., the distance which separates the rear charge from the front charge during the impact of the front charge on the target as more fully described in FIG. 3 set forth below. $\Delta X_D$ is close to $$\frac{Vo + \Delta Vo}{\Delta Vo} L \tag{D}$$

Still according to this first embodiment of the invention and with reference to FIG. 2, wire 3, prior to its unwinding, can of course and preferentially (although not in a limiting way) be coiled in the bottom of bore 7.

With reference now to FIG. 3 and still according to this embodiment of the invention, the tension of wire 3 at the end of its unwinding is limited by an apparent increase of the lengthening of said wire by adding to its lengthening the stroke of a damping device or of a safety and cocking device (S.C.D.) 11 of a pyrotechnic fuse tied to the end of said wire. The safety armament unit 11 (FIG. 3) has a firing pin 11*a*, a firing pin spring 11*b*, and an armament fork for the firing pin 11*c*. The pulling of the wire by means of the fork 11*c* arms the firing pin 11*a* by virtue of the compression of the spring 11*b*. The course of the elastic compression of the spring 11*b* ensures the progressiveness of the end of the relative spacing movement of the two projectiles and the corresponding absorption of their differences in velocity. During the impact on the target by the front projectile the tension of wire 3 is released causing the releasing of the spring and resulting in the functioning of the firing pin.

When referring also to FIGS. 5 and 6, and still according to this embodiment of the invention, the extra speed $\Delta$Vo of the head projectile is cancelled at the end of the unwinding of connecting wire 3 by the passage of said wire through a die 17 connected either to the rear projectile 2 or the head projectile 1.

Wire 3 is therefore placed at the start on both sides of die 17 and the work corresponding to the cancellation of ΔVo is clearly less than that which would correspond to the passage through said die of the whole length of said wire situated initially upstream of said die.

Still according to this embodiment of the invention, the connecting wire 3 is made of a plastic material, for example a polyamide.

Figure 4:
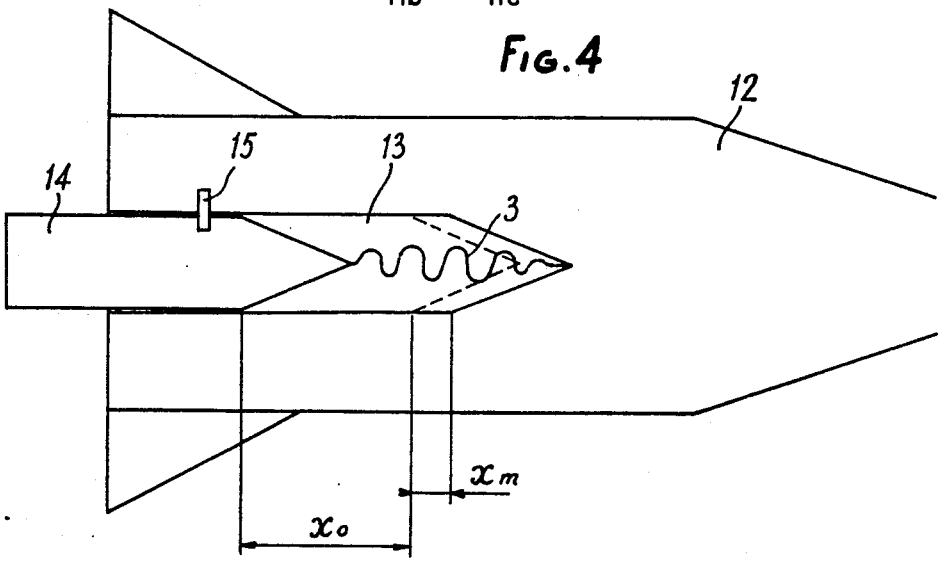
FIG. 4 is a view of the initial position of the head projectile shell base on the ogive of the second projectile, according to a second embodiment of the invention in which the head projectile forms the main projectile.

According to a second embodiment of the invention shown in FIG. 4, the head projectile 12 includes the main charge and is forming the main projectile. It is formed at the rear with a bore 13 inside which is coiled the connecting wire, and the ogive of the rear projectile 14 is fixed, until the shot is fired, by one or several pegs 15. According to this second embodiment of the invention, the choice of ΔVo, the setting of the pressure Pm as well as the heights or air $x_m$ and $x_o$ are preferentially defined as in the first embodiment of the invention hereabove described.

What is claimed is:

1. A system of tandem charge projectiles, of the type to be projected by a launcher along a trajectory and intended for attacks on armored vehicles, the armor on the vehicles having a predetermined life, the tandem charge projectiles comprising two separate projectiles comprising a front projectile and a rear projectile each projectile including an explosive effect charge, said front and rear projectiles being connected by a connecting wire, the length (L) of the wire and the velocity (V) of the projectiles being determined such that the relationship (L)/(V) is greater than said predetermined life ($\Delta_T$) of the armor to be attacked, and means for projecting the front projectile from the launcher, with an additional initial velocity ($\Delta V_0$) with respect to an initial velocity ($V_0$) of the rear projectile, so that the rear projectile follows the front projectile.

2. The system of claim 1 wherein said connecting wire is a wound wire and means for unwinding the wire during the trajectory of the projectiles to a final distance ($\Delta X_D$) and further including means for initial impacting, the front projectile a distance ($\Delta X_m$), separating the front and rear charges which is greater than ($\Delta X_D$).

3. The system of claim 1 wherein said connecting wire is wound and including means for unwinding the wire, further comprising means for maintaining tension in the wire.

4. The system of claim 1 wherein said front projectile has a better ballistic coefficient than said rear projectile.

5. The system of claim 3 wherein said means for maintaining tension is a cruising thruster.

6. The system of claim 1 wherein said front projectile and said rear projectile have means for imparting stability so that in flight the wire, when tensioned, imparts aerodynamic stability to the projectiles.

7. The system according to claim 1 wherein said rear projectile contains a main charge and forms the main projectile.

8. The system of claim 1 wherein said front projectile contains a main charge and forms the main projectile.

9. The system of claim 1 wherein said front and rear projectiles are fixed to each other by at least one peg which is sheared when the projectiles are fired because of the effect of inertia forces.

10. The system of claim 1 wherein the front projectile is fixed to the rear projectile by at least one shearable peg and there are means for maintaining compressed air behind the front projectile.

11. The system of claim 1 including means for increasing the apparent lengthening of the wire due to the addition of the stroke of a damping or of a cocking device for a pyrotechnic fuse tied to the end of said wire.

12. The system of claim 1 including means for cancelling said additional velocity of said head projectile after said wire has been unwound.

13. The system of claim 12 wherein the canceling means includes a die connected to either said front or said rear projectile through which said wire will pass.

14. The system of claim 13 wherein the wire is wound and wherein part of the wound wire is on one side of the die and part of the wound wire is on the other side of the die.

15. The system of claim 1 wherein said wire is of plastic material.

16. The system of claim 15 wherein the plastic is polyamide.

17. The system of claim 1 wherein said front projectile or said rear projectile has a hollow charge therein.

18. The system of claim 10 including means for providing balance to the pressure of the compressed air at the rear of the front projectile with the inertia forces corresponding to acceleration characterizing the passage of said front projectile through a launcher muzzle.

* * * * *